US008660273B2

(12) United States Patent
Wang

(10) Patent No.: US 8,660,273 B2
(45) Date of Patent: Feb. 25, 2014

(54) INTERFACE CIRCUIT AND ELECTRONIC DEVICE USING THE SAME

(75) Inventor: Tao Wang, Shenzhen (CN)

(73) Assignees: Hong Fu Jin Precision Industry (ShenZhen) Co., Ltd, Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 629 days.

(21) Appl. No.: 12/873,337

(22) Filed: Sep. 1, 2010

(65) Prior Publication Data

US 2012/0020478 A1 Jan. 26, 2012

(30) Foreign Application Priority Data

Jul. 21, 2010 (CN) ..... 2010 1 0232940

(51) Int. Cl.
*H04R 27/04* (2006.01)

(52) U.S. Cl.
USPC ..... 381/74

(58) Field of Classification Search
CPC ..... H04R 5/033; H04R 1/1041
USPC ..... 381/74, 17–22, 1–4, 61, 63, 80, 81, 381/123, 59, 300, 84, 85; 700/94
See application file for complete search history.

(56) References Cited

U.S. PATENT DOCUMENTS

| | | | | |
|---|---|---|---|---|
| 3,944,941 | A | 3/1976 | Tsuda | |
| 4,688,042 | A * | 8/1987 | Cronson et al. | 342/19 |
| 6,069,960 | A * | 5/2000 | Mizukami et al. | 381/74 |
| 6,928,175 | B1 * | 8/2005 | Bader et al. | 381/123 |
| 7,769,187 | B1 * | 8/2010 | Farrar et al. | 381/74 |
| 7,986,793 | B2 * | 7/2011 | Wilson | 381/81 |

FOREIGN PATENT DOCUMENTS

| | | | |
|---|---|---|---|
| JP | 58-161494 | * | 9/1983 |
| JP | 58161494 A | | 9/1983 |

* cited by examiner

*Primary Examiner* — Lun-See Lao
(74) *Attorney, Agent, or Firm* — Altis Law Group, Inc.

(57) ABSTRACT

An electronic device includes a processing unit for outputting a right channel audio signal and a left channel audio signal, and an interface circuit for generating a processed right channel audio signal and a processed left channel audio signal accordingly. The interface circuit includes two output units for electrically connecting two plugs of two speakers respectively. Each output unit includes a first pin, a second pin, and an anti-jam member. When a plug is inserted into the output unit, the first pin transmits the processed right channel audio signal to the plug, the second pin transmits the processed left channel audio signal to the plug, and the anti jam member is in an open state. When the plug is dependent from the output unit, the first pin is in series with the second pin by the anti jam member.

9 Claims, 3 Drawing Sheets

INTERFACE CIRCUIT AND ELECTRONIC DEVICE USING THE SAME

BACKGROUND

1. Technical Field

The present disclosure relates to electronic devices, and particularly to an electronic device with an interface circuit.

2. Description of Related Art

Electronic devices, such as DVD players, usually include an interface circuit for peripherals. The interface circuit for a DVD player may includes two output units for respectively transmitting right channel audio signals and left channel audio signals to two speakers. When one output unit connects with one speaker and the other output unit does not connect with the other speaker a signal cross-disturbance exits between the two output units, thus one of the right channel audio signals or the left channel audio signals output by the unit unconnected with the speaker will disturb the other channels output.

Therefore, there is room for improvement in the art.

BRIEF DESCRIPTION OF THE DRAWINGS

The components of the drawings are not necessarily drawn to scale, the emphasis instead being placed upon clearly illustrating the principles of the embodiment of an electronic device with a mute control circuit. Moreover, in the drawings, like reference numerals designate corresponding parts throughout the views.

DETAILED DESCRIPTION

Embodiments of the present disclosure will now be described in detail with reference to the drawings.

Figure 1:
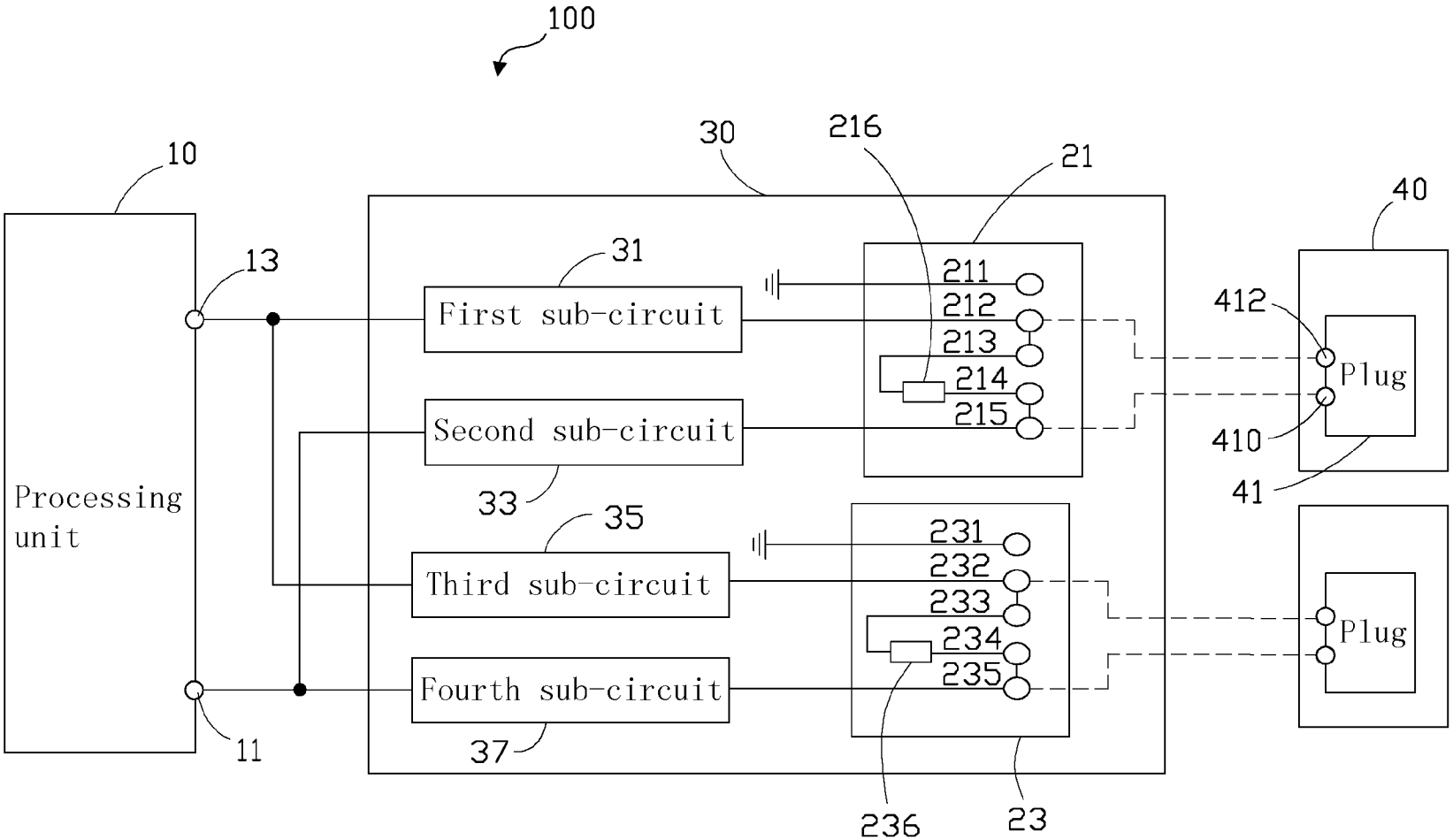
FIG. 1 is a functional block diagram of an electronic device including an interface circuit according to an exemplary embodiment.

Referring to FIG. 1, an electronic device 100 according to an exemplary embodiment is illustrated. In this embodiment, the electronic device 100 is a DVD player. The electronic device 100 includes a processing unit 10, an interface circuit 30, and two speakers 40.

The processing unit 10 is used for generating audio signals including a right channel audio signal and a left channel audio signal. The processing unit 10 includes a first output port 11 and a second output port 13. The first output port 11 is used to output the left channel audio signal. The second output port 13 is used to output the right channel audio signal.

The interface circuit 30 is electrically connected to the processing unit 10. The interface circuit 30 is used for transmitting the right channel audio signal and the left channel audio signal to the two speakers 40 when the two speakers 40 are electrically connected to the interface circuit 30. The two speakers 40 emit sounds according to the right channel audio signal and the left channel audio signal. Each speaker 40 includes a plug 41 for electrically connecting to the interface circuit 30. Each plug 41 includes a first input port 410 and a second input port 412.

The interface circuit 30 includes a first output unit 21, a second output unit 23, a first sub-circuit 31, a second sub-circuit 33, a third sub-circuit 35, and a fourth sub-circuit 37.

The first sub-circuit 31 and the third sub-circuit 35 are the same and are both used for processing the right channel audio signal from the second output port 13, and for generating a processed right channel audio signal.

The second sub-circuit 33 and the fourth sub-circuit 37 are the same and are both used for processing the left channel audio signal from the first output port 11, and for generating a processed left channel audio signal.

The first output unit 21 and the second output unit 21 are the same. The first output unit 21 is used for receiving the processed right channel audio signal from the first sub-circuit 31 and the processed left channel audio signal from the second sub-circuit 33. It is further used for transmitting the processed right channel audio signal and the processed left channel audio signal to the speaker 40, which is electrically connected to the first output unit 21.

The first output unit 21 includes a first pin 213, a second pin 214, a third pin 211, a fourth pin 212, a fifth pin 215, and a first anti jam member 216. The third pin 211 is electrically grounded. The fourth pin 212 is electrically connected to the second output port 13 by the first sub-circuit 31. The first pin 213 is detachably and is electrically connected to the fourth pin 212. The first pin 213 is further electrically connected to the second pin 214 by the first anti-jam member 216. The second pin 214 is detachably and is electrically connected to the fifth pin 215. The fifth pin 215 is further electrically connected to the first output port 11 by the second sub-circuit 33.

When the speaker 40 is connected to the first output unit 21, the first pin 213 is detached from the fourth pin 212, and the second pin 214 is detached from the fifth pin 215. The first anti-jam member 216 is in an open circuit. The fourth pin 212 is electrically connected to the second input port 412 to transfer the processed right channel audio signal. The fifth pin 215 is electrically connected to the first input port 410 to transfer the processed left channel audio signal. Thus, the first anti jam member 216 does not affect the first output unit 21 to transmit the processed right channel audio signal and the processed left channel audio signal to the speaker 40.

When the speaker 40 is independent from the first output unit 21, the first pin 213 is electrically connected to the fourth pin 212, and the second pin 214 is electrically connected to the fifth pin 215. The first anti jam member 216 is in series with the fourth pin 212 and the fifth pin 215. Thus, the first anti jam member 216 attenuates the processed right channel audio signal and the processed left channel audio signal.

The second output unit 23 is used for receiving the processed right channel audio signal from the third sub-circuit 35 and the processed left channel audio signal from the fourth sub-circuit 37. The second output unit 23 is further used for transmitting the processed right channel audio signal and the processed left channel audio signal to one of the speakers 40, which is electrically connected to the first output unit 21.

The second output unit 23 includes a sixth pin 233, a seventh pin 234, an eighth pin 231, a ninth pin 232, a tenth pin 235, and a second anti jam member 236. The eighth pin 231 is electrically grounded. The ninth pin 232 is electrically connected to the second output port 13 by the third sub-circuit 35. The ninth pin 232 is further detachably and is electrically connected to the sixth pin 233. The sixth pin 233 is electrically connected to the seventh pin 234 by the second anti jam member 236. The seventh pin 234 is detachably and is electrically connected to the tenth pin 235. The tenth pin 235 is further electrically connected to the first output port 11 by the fourth sub-circuit 37.

When the speaker 40 is connected to the second output unit 23, the ninth pin 232 is detached from the sixth pin 233, and the tenth pin 235 is detached from the seventh pin 234. The second anti-jam member 236 is in an open circuit. The ninth pin 232 is electrically connected to the second input port 412 to transfer the processed right channel audio signal. The tenth pin 235 is electrically connected to the first input port 410 to transfer the processed left channel audio signal. Thus, the second anti jam member 236 does not affect the second output unit 23 to transmit the processed right channel audio signal and the processed left channel audio signal to the speaker 40.

When the speaker 40 is independent from the second output unit 23, the ninth pin 232 is electrically connected to the sixth pin 233, and the tenth pin 235 is electrically connected to the seventh pin 234. The second anti jam member 236 is connected in series with the ninth pin 232 and the tenth pin 235. Thus, the second anti jam member 236 attenuates the processed right channel audio signal and the processed left channel audio signal.

Referring to FIG. 1 again, when the first output unit 21 electrically connects with the speaker 40, and the second output unit 23 is independent from the speaker 40. A loop circuit will be formed by the second output port 13, the third sub-circuit 35, the ninth pin 232, the sixth pin 233, the second anti jam member 236, the seventh pin 234, the tenth pin 235, the fourth sub-circuit 37, the second sub-circuit 33, the fifth pin 215, the second pin 214, and the first input port 410. Thus, the processed right channel audio signal will reach the first input port 410 through the loop circuit. The processed left channel audio signal of the first input port 410 is disturbed. However, as the second anti jam member 236 is in series with the loop circuit, it attenuates the processed right channel audio signal. After being attenuated, the processed right channel audio signal can not affect the processed left channel audio signal of the first input port 410.

For the same reason, the processed left channel audio signal cannot affect the processed right channel audio signal of the second input port 412. When the second output unit 23 is connected to the speaker 40, and the first output unit 21 is independent from the speaker 40. The processed right channel audio signal cannot affect the processed left channel audio signal of the first input port 410, and the processed left channel audio signal cannot affect the processed right channel audio signal of the second input port 412.

Figure 2:
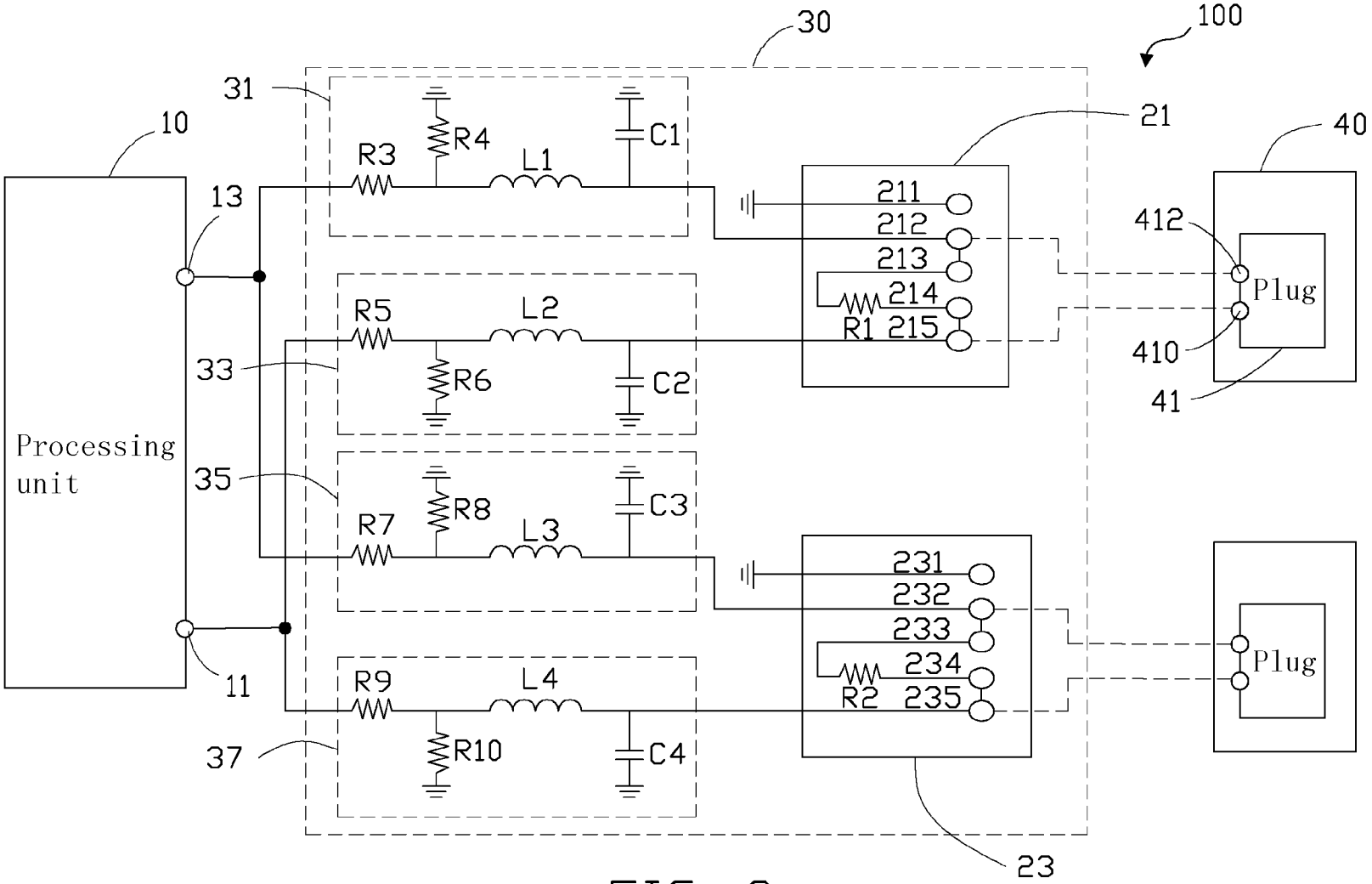
FIG. 2 is a detailed circuit diagram of the interface circuit of FIG. 1 in an initial state.

Further referring to FIG. 2, in this embodiment, the first anti jam member 216 is a first resistor R1, and the second anti jam member 236 is a second resistor R2.

The first sub-circuit 31 is used for transmitting the right channel signal from the second output port 13 to the fourth pin 212 of the first output unit 21. The first sub-circuit 31 includes a third resistor R3, a fourth resistor R4, a first inductor L1, and a first capacitor C1. One end of the third resistor R3 is electrically connected to the second output port 13, and the other end of the third resistor R3 is electrically connected to the fourth pin 212 by the first inductor L1. One end of the fourth resistor R4 is electrically connected between the third resistor R3 and the first inductor L1, and the other end of the fourth resistor R4 is electrically grounded. One end of the first capacitor C1 is electrically connected to the fourth pin 212, and the other end of the first capacitor C1 is electrically grounded. The third resistor R3, the first inductor L1, and the first capacitor C1 define a RLC filtering circuit for filtering signals. The fourth resistor R4 is a pull down voltage resistor.

The second sub-circuit 33 is used for transmitting the left channel signal from the first output port 11 to the second pin 214 of the first output unit 21. The second sub-circuit 33 includes a fifth resistor R5, a sixth resistor R6, a second inductor L2, and a second capacitor C2. One end of the fifth resistor R5 is electrically connected to the first output port 11, and the other end of the fifth resistor R5 is electrically connected to the fifth pin 215 by the second inductor L2. One end of the sixth resistor R6 is electrically connected between the fifth resistor R5 and the second inductor L2, and the other end of the sixth resistor R6 is electrically grounded. One end of the second capacitor C2 is electrically connected to the fifth pin 215, and the other end of the second capacitor C2 is electrically grounded. The fifth resistor R5, the second inductor L2, and the second capacitor C2 define a RLC filtering circuit for filtering signals. The sixth resistor R6 is a pull down voltage resistor.

The third sub-circuit 35 is used for transmitting the right channel signal from the second output port 13 to the sixth pin 233 of the second output unit 23. The third sub-circuit 35 includes a seventh resistor R7, an eighth resistor R8, a third inductor L3, and a third capacitor C3. One end of the seventh resistor R7 is electrically connected to the second output port 13, and the other end of the seventh resistor R7 is electrically connected to the ninth pin 232 by the third inductor L3. One end of the eighth resistor R8 is electrically connected between the seventh resistor R7 and the third inductor L3, and the other end of the eighth resistor R8 is electrically grounded. One end of the third capacitor C3 is electrically connected to the ninth pin 232, and the other end of the third capacitor C3 is electrically grounded. The seventh resistor R6, the third inductor L3, and the third capacitor C3 define a RLC filtering circuit for filtering signals. The eighth resistor R8 is a pull down voltage resistor.

The fourth sub-circuit 37 is used for transmitting the left channel signal from the first output port 11 to the seventh pin 234 of the second output unit 23. The fourth sub-circuit 33 includes a ninth resistor R9, a tenth resistor R10, a fourth inductor L4, and a fourth capacitor C4. One end of the ninth resistor R9 is electrically connected to the first output port 11, and the other end of the ninth resistor R9 is electrically connected to the tenth pin 235 by the fourth inductor L4. One end of the tenth resistor R10 is electrically connected between the ninth resistor R9 and the fourth inductor L4, and the other end of the tenth resistor R10 is electrically grounded. One end of the fourth capacitor C4 is electrically connected to the tenth pin 235, and the other end of the fourth capacitor C4 is electrically grounded. The ninth resistor R9, the fourth inductor L4, and the fourth capacitor C4 define a RLC filtering circuit for filtering signals. The tenth resistor R10 is a pull down voltage resistor.

The third resistor R3, the fifth resistor R5, the seventh resistor R7, and the ninth resistor R9 have the same resistance. Each resistance of the first resistor R1 and the second resistor R2 is far greater than that of the third resistor R3. In this embodiment, each resistance of the first resistor R1 and the second resistor R2 is about 3 to 10 times the third resistor R3.

Figure 3:
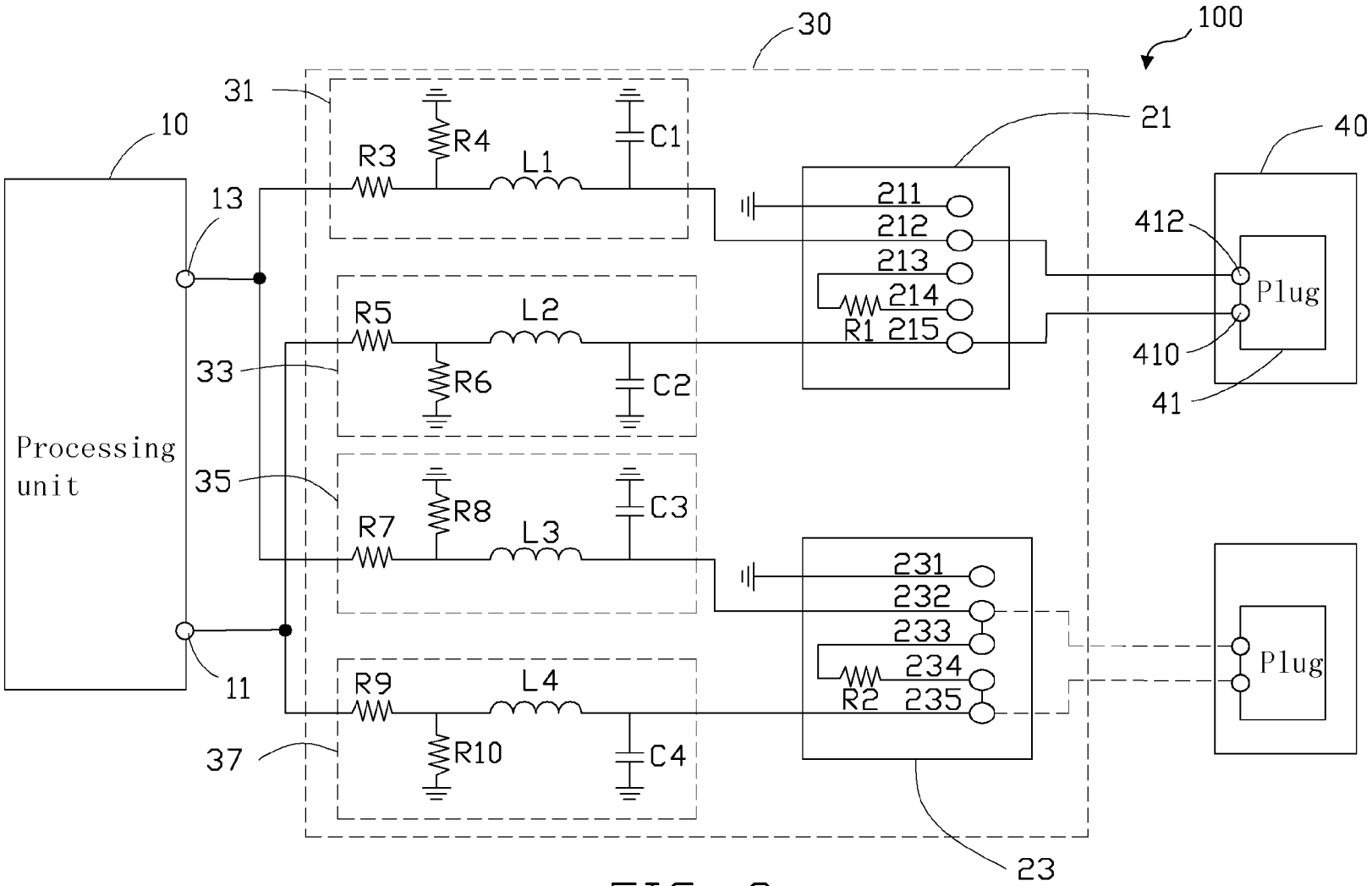
FIG. 3 is a detailed circuit diagram of the interface circuit of FIG. 1 in a working state.

Further referring to FIG. 3, when the first output unit 21 is connected to the speaker 40, and the second output unit 23 is independent from the speaker 40, the first anti jam member 216 is in an open circuit, and the second anti jam member 236 is in series with the ninth pin 232 and the tenth pin 215. The fourth pin 212 is electrically connected to the second input port 412. The fifth pin 215 is electrically connected to the first input port 410. As the second resistor R2 has a great resistance, the second resistor R2 attenuates the processed right channel audio signal to the first input port 410 or attenuates the processed left channel audio signal to the second input port 412.

As discussed above, when only one speaker 40 is connected to one of the first output units 21 and the second output unit 23 of the electronic device 100, the first output unit 21 and the second output unit 23 connected to the speaker 40 will not be affected by the other first output unit 21 and the second output unit 23. Cross talk between the processed left channel audio signal and the processed right channel audio signal is reduced.

While various exemplary and preferred embodiments have been described, it is to be understood that the disclosure is not limited thereto. To the contrary, various modifications and similar arrangements (as would be apparent to those skilled in the art) are intended to also be covered. Therefore, the scope of the appended claims should be accorded the broadest interpretation to encompass all such modifications and similar arrangements.

What is claimed is:

1. An interface circuit for receiving a right channel audio signal and a left channel audio signal, and generating a processed right channel audio signal and a processed left channel audio signal accordingly, the interface circuit comprising:

two output units for electrically connecting two plugs of two speakers respectively, each output unit comprising a first pin, a second pin, and an anti jam member, when a plug is inserted into the output unit, the first pin transmits the processed right channel audio signal to the plug, the second pin transmits the processed left channel audio signal to the plug, and the anti jam member is in an open state, when the plug is dependent from the output unit, the first pin is in series with the second pin by the anti jam member, and the anti jam member attenuates one of the processed right channel audio signal and the processed left channel audio signal;

wherein each output unit further comprises four sub-circuits, two ends of two sub-circuits are electrically connected together for receiving the right channel audio signal, the other two ends of the two sub-circuits are respectively and electrically connected to the two first pins for outputting the processed right channel audio signal, two ends of the other two sub-circuits are electrically connected together for receiving the left channel audio signal, the other two ends of the other two sub-circuits are respectively and electrically connected to the two second pins for outputting the processed left channel audio signal; each sub-circuits comprises a first resistor, a second resistor, an inductor, and a capacitor;

one end of the first resistor for receiving the left channel audio signal or the right channel audio signal;

one end of the second resistor electrically connected to the other end of the first resistor, and the other end of the second resistor electrically grounded; one end of the inductor electrically connected between the first resistor and the second resistor, when the first resistor receives the right channel audio signal, the other end of the inductor is electrically connected to the corresponding first pin, when the first resistor receives the left channel audio signal, the other end of the inductor electrically connected to the corresponding second pin; one end of the capacitor electrically connected to the other end of the inductor, and the other end of the capacitor electrically grounded.

2. The interface circuit of claim 1, wherein when the plug is inserted into the output unit, the anti jam member is detached from the first pin to be in the opening circuit state, and the first pin and the second pin respectively transmit the processed right channel audio signal and the processed left channel audio signal to the speaker, when the plug is out of the output unit, the anti-jam member is electrically connected between the first pin and the second pin.

3. The interface circuit of claim 1, wherein each anti jam member comprises a resistor.

4. The interface circuit of claim 1, wherein the first resistor, the inductor, and the capacitor defines a RLC filtering circuit, the second resistor is a pull down voltage resistor.

5. The interface circuit of claim 1, wherein each resistance of the two anti-jam members is about 3 to about 10 times resistance of the first resistor.

6. An electronic device, comprising:

a processing unit for outputting a right channel audio signal and a left channel audio signal; and an interface circuit for receiving the right channel audio signal and the left channel audio signal, and generating a processed right channel audio signal and a processed left channel audio signal accordingly, the interface circuit comprising two output units for electrically connecting two plugs of two speakers respectively, each output unit comprising a first pin, a second pin, and an anti jam member, when a plug is inserted into the output unit, the first pin transmits the processed right channel audio signal to the plug, the second pin transmits the processed left channel audio signal to the plug, and the anti jam member is in an opening circuit state, when the plug is dependent from the output unit, the first pin is in series with the second pin by the anti-jam member;

wherein each output unit further comprises four sub-circuits, and each sub-circuits comprises a first resistor, a second resistor, an inductor, and a capacitor; one end of the first resistor for receiving the left channel audio signal or the right channel audio signal; one end of the second resistor electrically connected to the other end of the first resistor, and the other end of the second resistor electrically grounded; one end of the inductor electrically connected between the first resistor and the second resistor, when the first resistor receives the right channel audio signal, the other end of the inductor is electrically connected to the corresponding first pin, when the first resistor receives the left channel audio signal, the other end of the inductor electrically connected to the corresponding second pin; one end of the capacitor electrically connected to the other end of the inductor, and the other end of the capacitor electrically grounded.

7. The electronic device of claim 6, wherein two ends of two sub-circuits are electrically connected together for receiving the right channel audio signal, the other two ends of the two sub-circuits are respectively and electrically connected to the two first pins for outputting the processed right channel audio signal, two ends of the other two sub-circuits are electrically connected together for receiving the left channel audio signal, the other two ends of the other two sub-circuits are respectively and electrically connected to the two second pins for outputting the processed left channel audio signal.

8. The electronic device of claim 6, wherein the first resistor, the inductor, and the capacitor defines a RLC filtering circuit, the second resistor is a pull down voltage resistor.

9. The electronic device of claim 6, wherein each resistance of the two anti-jam members is about 3 to 10 times resistance of the first resistor.

* * * * *